US007533625B2

(12) United States Patent
Lambertus et al.

(10) Patent No.: US 7,533,625 B2
(45) Date of Patent: May 19, 2009

(54) UNMANNED UNDERWATER VESSEL

(75) Inventors: Detlef Lambertus, Osterholz-Scharmbeck (DE); Ralf Richter, Oyten (DE)

(73) Assignee: Atlas Elektronik GmbH, Bremen (DE)

( * ) Notice: Subject to any disclaimer, the term of this patent is extended or adjusted under 35 U.S.C. 154(b) by 2 days.

(21) Appl. No.: 11/667,125

(22) PCT Filed: Dec. 2, 2005

(86) PCT No.: PCT/EP2005/012911

§ 371 (c)(1),
(2), (4) Date: May 7, 2007

(87) PCT Pub. No.: WO2006/063695

PCT Pub. Date: Jun. 22, 2006

(65) Prior Publication Data

US 2008/0121165 A1 May 29, 2008

(30) Foreign Application Priority Data

Dec. 14, 2004 (DE) ..... 10 2004 060 010

(51) Int. Cl.
*B63G 8/08* (2006.01)

(52) U.S. Cl. ..... 114/338; 114/337; 440/71

(58) Field of Classification Search ..... 114/312, 114/330, 331, 337, 338; 440/71, 72
See application file for complete search history.

(56) References Cited

U.S. PATENT DOCUMENTS 3,828,719 A 8/1974 Cooke
6,366,533 B1 * 4/2002 English ..... 367/131
6,645,020 B1 * 11/2003 Barker ..... 440/71
2004/0092176 A1 5/2004 Allen

FOREIGN PATENT DOCUMENTS

JP 57205295 12/1982
WO WO 03/011683 A1 2/2003

OTHER PUBLICATIONS

Helmut Bieler, Welchen Weg Geht Die Minenjagd?, Jul. 1, 1996, vol. 39, No. 7, pp. 469-473.
E. Eugene Allmendinger: "Submersible Vehicle Systems Design", 1990, The Society of Naval Architects and marine Engineers, Jersey City, NJ, paragraph 04.1 and paragraph 3.7.1, p. 181, left-hand col., line 3-right-hand col., line 4; figure 74.

* cited by examiner

*Primary Examiner*—Lars A Olson
(74) *Attorney, Agent, or Firm*—Fitch, Even, Tabin & Flannery; Norman N. Kunitz

(57) ABSTRACT

With an unmanned underwater vessel having a pressure hull, drive assembly and at least one ancillary device arranged on the pressure hull, for example a propeller protection apparatus (15), the at least one ancillary device (15) is fixedly connected to a lifting body (16), which has a lower density than the density of the water, in order to make it possible to replace the ancillary devices or to arrange additional ancillary devices on the pressure hull without changing the trim of the underwater vessel as a result. The density and volume of the lifting body (16) are selected such that the lifting force acting in the water on the ancillary device (15) and the lifting body (16) compensates for the force of gravity acting on the ancillary device (15) and the lifting body (16).

12 Claims, 3 Drawing Sheets

UNMANNED UNDERWATER VESSEL

BACKGROUND OF THE INVENTION

Figure 1:
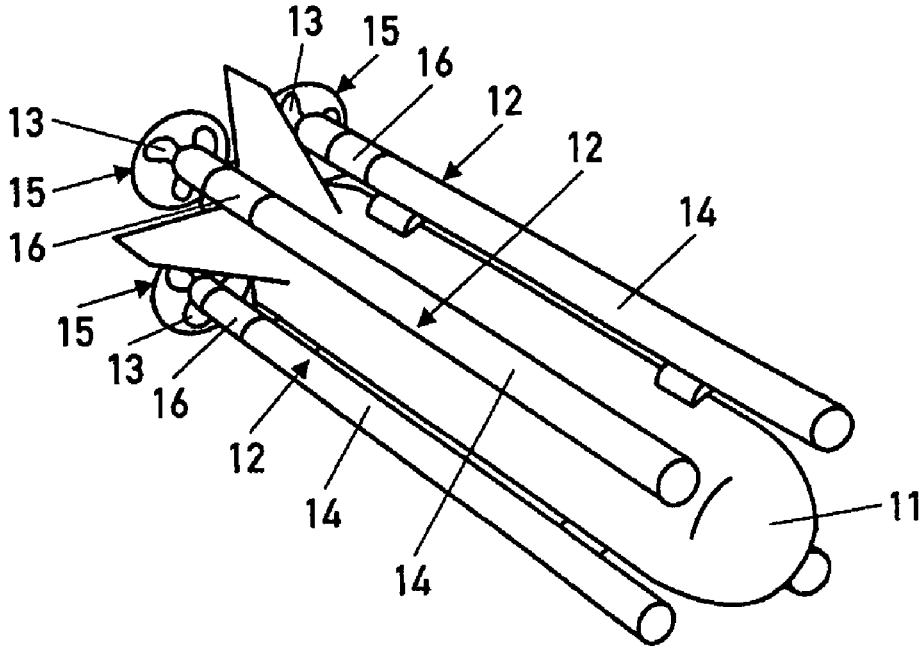

The invention relates to an unmanned underwater vessel of the generic type having a pressure hull, a drive assembly, and at least one ancillary device arranged on the pressure hull.

Self-driven, preferably propeller-driven, unmanned underwater vessels are used as autonomously operating vessels or as vessels which are remote-controlled via a data transmission cable for the purpose of carrying out various tasks under water, so-called missions, such as for reconnaissance work on the topography of the seabed, for clearing mines and the destruction of mines. In this case, similarly designed vessels are equipped with different devices and components, depending on the profile of requirements, and these devices and components are arranged in various regions on the pressure hull of the vessels. The vessel, which is equipped in accordance with a specific profile of requirements, is trimmed individually, such that it has an almost horizontal alignment in the water and is thus largely stabilized horizontally and against rolling. Deviations from the hydrodynamics are picked up by closed-loop control circuits to which the drive device is connected. If the vessel is intended to be changed over to another mission task, it needs to be completely retrimmed again after it has been converted. In this case, not only does the trim of the converted underwater vessel need to be recalculated and tested, but also the closed-loop control circuits for the drive assembly need to be readapted in order to ensure stable steering of the underwater vessel with the new trim.

The invention is based on the object, in the case of an underwater vessel with ancillary devices, of designing the ancillary devices such that they can both be used to replace existing ancillary devices of other types and arranged on the pressure hull in addition to the existing ancillary devices without the trim of the underwater vessel having to be changed as a result.

SUMMARY OF THE INVENTION

The above object generally is achieved according to the invention by an underwater vessel having a pressure hull, a drive assembly, and at least one ancillary device arranged on the pressure hull: and wherein: the at least one ancillary device is fixedly connected to a lifting body, which has a lower density than the density of the water. with the density and volume of the lifting body being selected such that the lifting force acting in the water on the ancillary device with the lifting body compensates for the force of gravity acting on the ancillary device and the lifting body.

The unmanned underwater vessel according to the invention has the advantage that, in the event of a change in the mission task of the underwater vessel or in the event of the customer desiring another use profile for the underwater vessel or in the event of the underwater vessel being converted for use in sea areas having different environmental parameters, the lowering-neutral design of the ancillary devices means that the underwater vessel can be equipped with the necessary components for the respective intended use without any problems by removing and/or attaching ancillary devices without the set trim of the underwater vessel being changed as a result. This not only means savings in terms of repeated trim calculations and trim tests for the converted underwater vessel but also means that the complex adaptation of the closed-loop control circuits for the drive assembly to a new trim is superfluous. Overall, this means that the unchanged basic vessel can be offered for all use profiles or can be changed over in the short term from one use profile to another with little conversion complexity.

Expedient embodiments of the underwater vessel according to the invention with advantageous developments and refinements of the invention are described in the further claims.

In accordance with one advantageous embodiment of the invention, the drive assembly of the underwater vessel has two or more propeller drives, which are accommodated in drive tubes, which are arranged distributed on the outside of the pressure hull and have a propeller protruding at one end of the tube. Each propeller drive has associated with it, as an ancillary device, a protection apparatus surrounding its propeller, and a lifting tube, which is fixedly connected to the protection apparatus, is pushed onto each drive tube of the propeller drives as the lifting body, which compensates for the lowering force of the protection apparatus. Such additional equipping of the underwater vessel with ancillary devices in the form of propeller protection apparatuses makes it possible to use the underwater vessel in areas of extremely shallow water, where coming into contact with the ground cannot be reliably ruled out, or in areas in which a large quantity of flotsam and jetsam may have accumulated. However, even in the case of underwater vessels which are not designed as one-use vessels but are repeatedly lowered and raised from onboard a mission ship, equipping the underwater vessel with propeller protection apparatuses is advantageous in order to prevent damage to the propellers owing to contact with the side of the vessel during the withdrawal and release operations. The lifting tubes, which are provided as lifting bodies for the purpose of compensating for the weight of the protection apparatuses, at the same time serve to hold the protection apparatuses on the underwater vessel.

In accordance with one advantageous embodiment of the invention, the ancillary device is an underwater antenna having an electroacoustic transducer arrangement, the lifting body, which compensates for the lowering force and is matched to the shape of the underwater antenna, being arranged on that side of the underwater antenna which faces away from the direction in which the sound is incident. Such underwater antennas are necessary when carrying out reconnaissance work on the seabed in relation to its topography or when detecting objects lying on the seabed, in particular mines, in connection with short-range sonars, in particular side-scan sonars. Here too, the underwater antenna is lowering-neutral, with the aid of the lifting body, such that, as a result of the attachment of the underwater antenna, which is provided with the lifting body, to the pressure hull, no change in the trim of the underwater vessel results. In each case an underwater antenna having a lifting body is preferably attached to a drive tube of a port-side and a starboard-side propeller drive.

In the same way as the attachment of the underwater antennas and the propeller protection apparatuses, it is also possible to attach further ancillary devices, which impart additional functions to the underwater vessel. For example, a TV camera can be inserted into that end of a drive tube which faces away from the propeller. The holder of a load-bearing frame, with which the underwater vessel can accommodate any desired loads, can be inserted into the front ends, facing away from the propellers, of a port-side and a starboard-side drive tube. Both the TV camera and the load-bearing frame are rigidly connected according to the invention to a lifting body, which compensates for the lowering force produced by the weight of the respective ancillary device on the underwater vessel by a lifting force acting on it.

The invention will be explained in more detail below with reference to an exemplary embodiment illustrated in the drawing.

BRIEF DESRIPTION OF THE DRAWING

Figure 2:
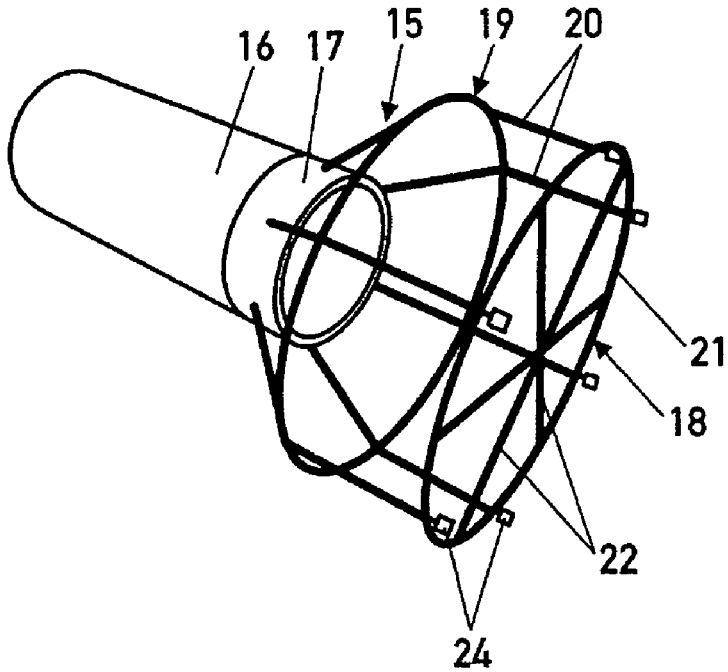
Figure 3:
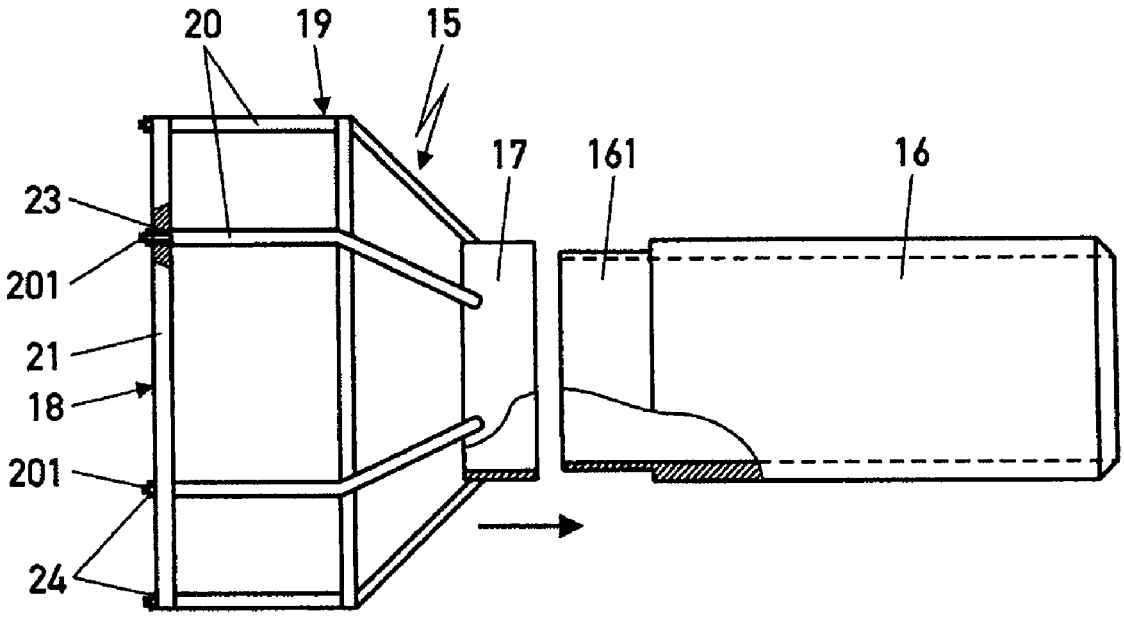
Figure 4:
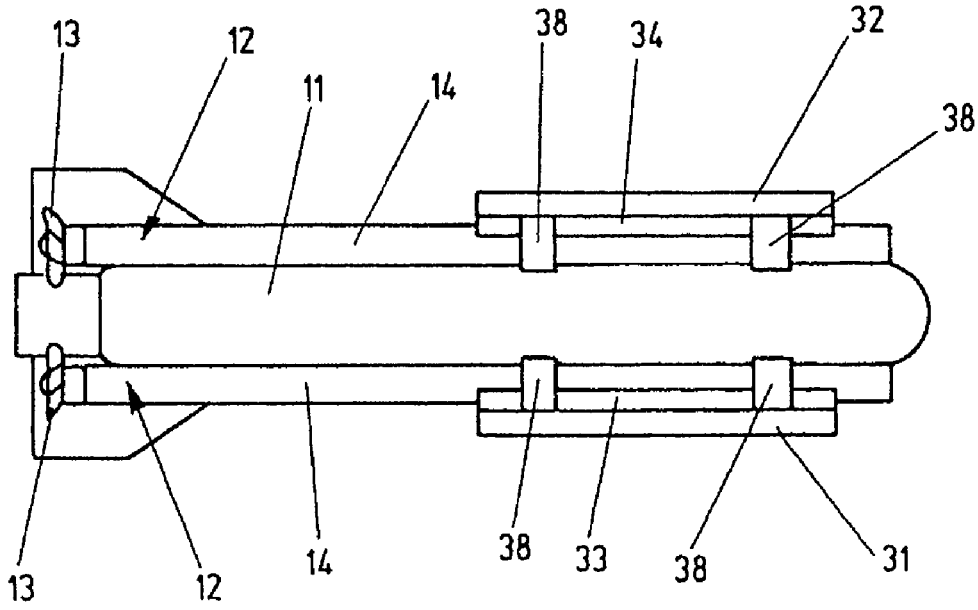
Figure 5:
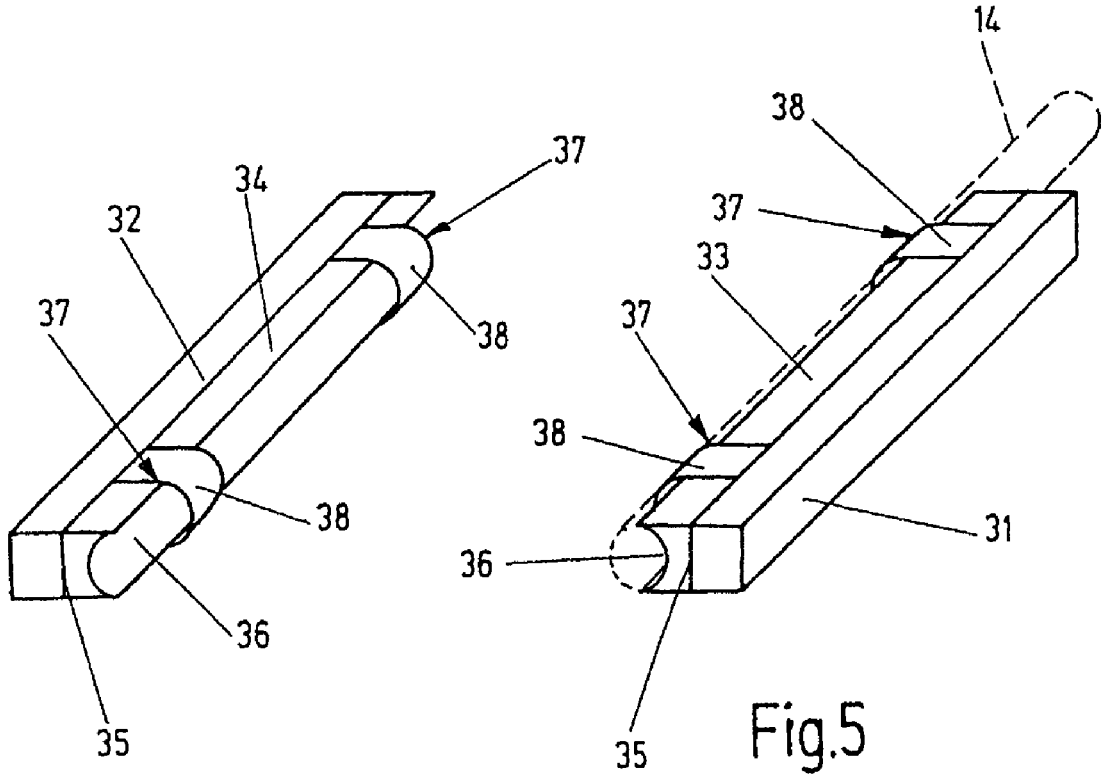

FIG. 1 shows a schematic illustration of a perspective view of an unmanned underwater vessel, FIG. 2 shows a perspective view of a propeller protection apparatus, which is attached to the underwater vessel shown in FIG. 1, having a lifting tube, FIG. 3 shows a partially cut-open side view of the propeller protection apparatus and lifting tube shown in FIG. 2, FIG. 4 shows a plan view of the underwater vessel shown in FIG. 1 after it has been converted using ancillary devices, FIG. 5 shows an enlarged illustration of a perspective view of the ancillary devices on the converted underwater vessel shown in FIG. 4.

DETAILED DESCRIPTION OF THE INVENTION

The unmanned underwater vessel, which is illustrated in a perspective view in FIG. 1, has a pressure hull 11 and a drive assembly comprising in total four propeller drives 12. Of the propeller drives 12, two are arranged on or close to the upper side of the pressure hull 11 and two on or close to the underside of the pressure hull 11, in each case on the starboard and port side of the pressure hull 11. Each propeller drive 12 has an electric motor, which drives a propeller 13 via a drive shaft. The electric motor and the drive shaft are accommodated in each case one drive tube 14 fixed to the pressure hull 11, the drive shaft being mounted such that it can rotate in the drive tube 14. The propeller 13 is placed onto that end of the drive shaft which protrudes out of the drive tube 14. Each propeller 13 is provided with a protection apparatus 15, which protects the propeller 13 against damage on contact with the ground, on contact with the wall of a vessel or by flotsam and jetsam.

Since the propeller protection apparatuses 15 make the underwater vessel more expensive and are not necessary in all use profiles, they are offered as an option such that the underwater vessel can be used both with and without propeller protection apparatuses 15. The propeller protection apparatuses 15 thus represent ancillary devices, which can be ordered as an accessory at the same time or can be subsequently attached when changing the use profile of the underwater vessel. The underwater vessel is trimmed carefully without the propeller protection apparatus 15 such that it assumes an almost horizontal position in the water. Deviations from the hydrodynamics are picked up by closed-loop control circuits, to which the propeller drives 12 are connected.

In order not to change the trim of the underwater vessel owing to the subsequent attachment of the propeller protection apparatuses 15, which would bring about the need for recalculation of the trim and readaptation of the closed-loop control circuits, each protection apparatus 15 is fixedly connected to a lifting body in the form of a lifting tube 16, whose density is less than the density of the water. The density and volume of the lifting body or of the lifting tube 16 are selected such that the lifting force acting in the water on the protection apparatus 15 with the lifting tube 16 compensates for the force of gravity acting on the protection apparatus 15 with the lifting body 16. Each combination of lifting tube 16 and protection apparatus 15 fixed thereto, as is illustrated perspectively in FIG. 2, is thus compensated for in terms of lowering and does not change the trim of the underwater vessel owing to its attachment to the pressure hull 11. As can be seen in FIG. 1, the attachment of the protection apparatuses 15 to the propeller drives 12 takes place by the fact that the lifting tube 16 of each protection apparatus 15 is pushed onto one of the four drive tubes 14 in an interlocking manner and is fixed thereon.

The lifting tube 16 is produced as a rotary part by metal-cutting from a material, whose density is less than the density of the water. The wall thickness of the lifting tube 16 is prescribed owing to the spatial relationships on the drive tube 14. The volume of the lifting tube 16 required for lifting is produced by an appropriate length for the lifting tube 16. The protection apparatus 15 is produced from metal or an impact-resistant plastic and thus has a density which is substantially greater than the density of water. Owing to the precise calculation of the length of the lifting body 16, a lowering force produced by the protection apparatus 15 is compensated for.

As shown in FIG. 3, the lifting tube 16 has an end section 161 having a reduced outer diameter for the purpose of accommodating, in an interlocking manner, a fixing ring 17 of the protection apparatus 15. The outer diameter of the end section 161 is thus dimensioned to be slightly smaller than the inner diameter of the fixing ring 17. The outer diameter of the fixing ring 17 is matched to the outer diameter of the lifting tube 16 such that the fixing ring 17 and the lifting tube 16 are flush with one another when the fixing ring 17 is pushed onto the end section 161.

The protection apparatus 15 is of two-part design for assembly reasons and comprises a protective grating 18, which covers the propeller 13 at one end, and a protective grating holder 19, which accommodates the protective grating 18 and at whose end, which faces the drive tube 14, the fixing ring 17 is arranged. In order to keep the weight of the protection apparatus 15 as low as possible, the protective grating holder 19 has axial webs 20, which are offset with respect to one another through the same circumferential angles, are bent back at an angle towards the fixing ring 17 and are fixed on the fixing ring 17. The protective grating 18 is placed onto the free ends of the axial webs 20 and fixed to the axial webs 20. The protective grating 18 has a ring 21 and radial struts 22 fixed to the ring 21. Holes 23 are arranged in the ring 21 such that they are offset with respect to one another through the same circumferential angles. The diameter of the holes 23 is smaller than the diameter of the axial webs 20. The end sections 201 of the axial webs 20 have a reduced diameter such that an annular shoulder is formed at a distance from the free end of the axial webs 20. The end sections 201 are also provided with a thread.

In order to attach the protection apparatus 15, initially the protective grating holder 19 is fixed on the lifting tube 16, which takes place, for example, by adhesively bonding the fixing ring 17 onto the end section 161 of the lifting tube 16. Alternatively, however, the fixing ring 17 may also be pushed onto the end section 161 and held by means of securing screws which have been screwed in radially. It is also possible for the end section 161 and the fixing ring 17 to be provided with corresponding threads such that the fixing ring 17 can be screwed onto the end section 161.

When the propeller 13 has not yet been mounted, the lifting tube 16 provided with the protective grating holder 19 is pushed onto a drive tube 14 in an interlocking manner and fixed on the drive tube 14. Subsequently, the propeller 13 is placed onto the shaft end protruding out of the drive tube 14 and fixed thereon. Then, the protective grating 18 is fixed to the protective grating holder 19 by the ring 21 of the protective grating 18 being guided with its holes 23 over the end sections 201 of the axial webs 20, until the ring 21 bears against the annular shoulders of the axial webs 20. Thread nuts 24 are then screwed onto the end sections 201 such that the ring 21 of the protective grating 18 is clamped against the annular shoulders of the axial webs 20.

FIG. 4 illustrates a plan view of the underwater vessel described, which is operated, however, without the optional propeller protection apparatuses 15. This underwater vessel is used for the purpose of detecting the topography of the seabed in a sea area and is equipped with a side-scan sonar for this purpose. The side-scan sonar comprises a port-side underwater antenna 31 and a starboard-side underwater antenna 32, each having an electroacoustic transducer arrangement. Each underwater antenna 31, 32 is attached to the pressure hull 11 of the underwater vessel as an ancillary device and is fixedly connected to a correspondingly designed lifting body 33 and 34, respectively, which is produced from a material having a density which is less than the density of water and is essentially matched to the circumferential contours of the underwater antenna 31 and 32, respectively. The lifting body 33 is in turn designed such that the lifting force acting on the combination of the underwater antenna 31 and the lifting body 33 or the underwater antenna 32 and the lifting body 34 in the water compensates for the force of gravity acting on the respective combination of the underwater antenna 31 or 32 and lifting body 33 or 34.

FIG. 5 shows a perspective illustration of the respective combination of the port-side underwater antenna 31 with the port-side lifting body 33 and the starboard-side underwater antenna 32 with the starboard-side lifting body 34. The lifting body 33 or 34 is arranged on that side of the underwater antenna 31 or 32 which faces away from the direction in which the sound is incident. Each lifting body 33 or 34 has, on sides facing away from one another, in each case a bearing surface 35 for the purpose of bearing against the underwater antenna 31 or 32 and a bearing surface 36 for the purpose of placing the lifting body 33 or 34 on a drive tube 14 of two propeller drives 12. The bearing surface 36 is shaped so as to correspond to the curvature of the drive tube 14. Provided on the underwater antenna 31, 32 are fixing means 37 which engage over the lifting bodies 33, 34 and are fixed to the respective drive tube 14. In the exemplary embodiment in FIGS. 4 and 5, the fixing means 37 are in the form of lugs 38, of which in each case two are fixed at a longitudinal distance from one another on the underwater antenna 31 or 32 and in each case surround the drive tube 14 of the port-side propeller drive 12. In FIG. 5, a drive tube 14 is indicated by dashed lines for reasons of clarity, the port-side underwater antenna 31 with the lifting body 33 being fixed to said drive tube 14. Alternatively, the underwater antennas 31, 32 can also be fixed, with respective bearing lifting bodies 33 and 34, directly to the pressure hull 11 on the starboard side and the port side.

The invention claimed is:

1. Underwater vessel having a pressure hull, a drive assembly, and at least one ancillary device arranged on the pressure hull; and wherein:

the at least one ancillary device is fixedly connected to a lifting body, which has a lower density than the density of the water, with the density and volume of the lifting body being selected such that the lifting force acting in the water on the ancillary device with the lifting body compensates for the force of gravity acting on the ancillary device and the lifting body;

the drive assembly has two or more propeller drives, which are accommodated in drive tubes, which are arranged distributed on the outside of the pressure hull and have a propeller protruding at one end of the tube; and each propeller drive has associated with it, as an ancillary device, a protection apparatus surrounding its propeller, and a lifting tube, which is fixedly connected to the protection apparatus and is pushed onto each drive tube as the lifting body.

2. Underwater vessel according to claim 1, wherein the lifting tube has an end section having a reduced outer diameter, and the protection apparatus has a fixing ring, which surrounds the end section and is fixed on the end section of the lifting tube.

3. Underwater vessel according to claim 2, wherein the outer diameter of the fixing ring is dimensioned to be equal to the outer diameter of the lifting tube such that the fixing ring and the lifting tube are flush with one another when the protection apparatus is pushed onto the lifting tube.

4. Underwater vessel according to claim 1, wherein the protection apparatus is made from metal or an impact-resistant plastic.

5. Underwater vessel according to claim 1, wherein the protection apparatus has a protective grating, which covers the propeller at one end, and a protective grating holder, which engages around the propeller and at whose one end the protective grating is fixed and at whose other end the fixing ring is arranged.

6. Underwater vessel according to claim 5, wherein the protective grating holder has axial webs, which are offset with respect to one another through circumferential angles, are bent back at an angle towards the fixing ring and are fixed to said fixing ring, and the protective grating is placed onto the free ends of the axial webs and fixed thereto.

7. Underwater vessel according to claim 5, wherein the protective grating has a ring and radial struts fixed to the ring, holes, which are offset through circumferential angles, are provided in the ring for the purpose of passing through the end sections of the axial webs, and the end sections of the axial webs are provided with a thread, with threaded nuts being screwed onto said end sections and fixedly clamping the protective grating on the protective grating holder.

8. Underwater vessel according to claim 7, wherein the holes provided in the ring are offset through the same circumferential angles.

9. Underwater vessel according to claim 1, wherein the drive assembly has four propeller drives.

10. Underwater vessel having a pressure hull, a drive assembly, and at least one ancillary device arranged on the pressure hull; and wherein;

the at least one ancillary device is fixedly connected to a lifting body, which has a lower density than the density of the water, with the density and volume of the lifting body being selected such that the lifting force acting in the water on the ancillary device with the lifting body compensates for the force of gravity acting on the ancillary device and the lifting body;

the ancillary device is an underwater antenna having an electroacoustic transducer arrangement; and the lifting body is arranged on that side of the underwater antenna which faces away from the direction in which sound is incident.

11. Underwater vessel according to claim 10, wherein the lifting body has a bearing surface for the purpose of bearing on the underwater antenna and a bearing surface for the purpose of bearing on the pressure hull or on a drive tube, said bearing surfaces in each case being matched to the contour of the underwater antenna or the pressure hull or the drive tube, and fixing means are provided which engage over the lifting body and can be fixed to the underwater antenna and to the pressure hull or to the drive tube.

12. Underwater vessel according to claim 6, wherein the protective grating holder axial webs are offset with respect to one another through the same circumferential angles.

* * * * *